US009510683B1

(12) United States Patent
Sharp

(10) Patent No.: US 9,510,683 B1
(45) Date of Patent: Dec. 6, 2016

(54) FOLDING CHAIR WITH INFLATABLE SEAT

(71) Applicant: Michael D. Sharp, Layton, UT (US)

(72) Inventor: Michael D. Sharp, Layton, UT (US)

( * ) Notice: Subject to any disclaimer, the term of this patent is extended or adjusted under 35 U.S.C. 154(b) by 0 days.

(21) Appl. No.: 14/744,483

(22) Filed: Jun. 19, 2015

(51) Int. Cl.

| | |
|---|---|
| ***A47C 4/28*** | (2006.01) |
| ***A47C 7/00*** | (2006.01) |
| ***A47C 27/08*** | (2006.01) |
| ***A47C 1/14*** | (2006.01) |
| ***A47C 4/42*** | (2006.01) |
| ***A47C 7/62*** | (2006.01) |

(52) U.S. Cl.
CPC ..... *A47C 7/008* (2013.01); *A47C 1/14* (2013.01); *A47C 4/42* (2013.01); *A47C 7/62* (2013.01); *A47C 27/081* (2013.01)

(58) Field of Classification Search
CPC ..... A47C 4/286; A47C 4/42; A47C 4/44; A47C 4/46; A47C 4/48; A47C 4/50; A47C 4/54; A47C 7/62; A47C 7/008; A47C 27/081; A47C 1/14
See application file for complete search history.

(56) References Cited

U.S. PATENT DOCUMENTS

| | | | | |
|---|---|---|---|---|
| 517,929 | A * | 4/1894 | March | A47C 9/00 108/128 |
| 4,216,933 | A | 8/1980 | Cramer, Jr. | |
| 4,752,057 | A | 6/1988 | Hagemes | |
| 4,934,638 | A | 6/1990 | Davis | |
| 5,494,333 | A | 2/1996 | Wilson | |
| 5,522,642 | A | 6/1996 | Herzog | |
| 6,036,148 | A | 3/2000 | Shank | |
| 6,247,749 | B1 | 6/2001 | Yu | |
| 6,270,156 | B1 * | 8/2001 | Metzger | A47C 9/105 297/16.2 |
| 6,382,729 | B1 * | 5/2002 | Wu | A47C 4/286 297/16.2 |
| 8,141,944 | B2 * | 3/2012 | Reeb | A47C 4/286 297/16.2 |
| 8,979,184 | B2 * | 3/2015 | Stafford | A47C 3/18 297/16.2 |
| 2002/0117878 | A1 * | 8/2002 | Fox | A47C 3/18 297/16.2 |
| 2009/0167063 | A1 * | 7/2009 | Brunner | A47C 4/286 297/16.1 |
| 2010/0314914 | A1 | 12/2010 | Mazzola | |
| 2010/0314926 | A1 * | 12/2010 | Chesness | A47C 4/286 297/258.1 |
| 2014/0306493 | A1 * | 10/2014 | Obolewicz | A47C 4/42 297/16.2 |

* cited by examiner

*Primary Examiner* — Philip Gabler
(74) *Attorney, Agent, or Firm* — Robert C. Montgomery; Montgomery Patent & Design, LLC

(57) ABSTRACT

A folding chair provides for leveling seating upon uneven ground. The chair includes folding chair frame with a pair of front leg assemblies and a pair of rear leg assemblies, each pivotally attached to a central hub. Each leg assembly has downwardly extending tubular portions and a means for securing the portions at a desired height. The adjustable legs provide a means for a level seating upon ground surfaces of varying elevations. The chair further utilizes inflatable arm rest, seat rest and back rest portions in one (1) embodiment.

16 Claims, 4 Drawing Sheets

FOLDING CHAIR WITH INFLATABLE SEAT

RELATED APPLICATIONS

None applicable.

FIELD OF THE INVENTION

The present invention relates generally to foldable chairs and seats and, more particularly, to a folding chair with independently adjustable legs for use on non-level surfaces.

BACKGROUND OF THE INVENTION

The folding camp-style chair is frequently used in a wide variety of outdoor events. These chairs provide a comfortable seating area whether at a campsite, a party, while watching sporting events, or simply relaxing in a backyard. The primary benefits contributing to this popularity are the fact that such chairs can be set up quickly, can collapse quickly, and can be easily transported and stored in a carrying bag.

While these chairs are generally well designed and honed for this purpose, they can be difficult to utilize in many of the outdoor locations where they are desired. For example, if such a chair is set on uneven ground, it is prone to rocking back and forth and can easily tip over during use. This is a safety issue, and makes using such chairs on uneven ground an aggravating situation.

Various attempts have been made to provide seating apparatuses with selectively adjustable legs. Examples of these attempts can be seen by reference to several U.S. Patents, such as U.S. Pat. No. 5,494,333; U.S. Pat. No. 5,522,642; U.S. Pat. No. 6,036,148; and U.S. Pat. No. 6,247,749.

While these devices fulfill their respective, particular objectives, each of these references suffer from one (1) or more disadvantages. Many such devices do not provide sufficient support and security to a user when deployed, particularly on an uneven surface. Many such devices are not easily collapsible or deployable without extensive manipulation. Accordingly, there exists a need for an adjustable, collapsible chair without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a convenient folding chair providing adjustable configurability for secure and stable use on uneven surfaces. Thus, the object of the present invention is to solve the aforementioned disadvantages and provide for this need.

To achieve the above objectives, it is an object of the present invention to provide a portable and adjustable chair having a pair of independently adjustable front and rear leg assemblies enabling use on an uneven or sloping surface. The apparatus includes a pair of arm rests, a seat rest, a back rest, and a frame comprising a pair of front leg assemblies, a pair of rear leg assemblies, a central hub, a pair of front upper braces, a pair of front lower braces, a pair of rear upper braces, and a pair of rear lower braces.

Another object of the present invention is to enable a user to utilize the leg-adjustment capabilities in order to provide height adjustment even when utilizing the apparatus on a flat, even surface.

Yet still another object of the present invention is to comprise a pivotingly joined structure of a generally rectangular shape that facilities ease of collapsing and deployment in a manner similar to a common camp-style chair. In a preferred embodiment, the frame is comprised of lightweight aluminum square tubular members that provide strong support during use while requiring minimum physical exertion to manipulate while collapsing, deploying, or adjusting the apparatus.

Yet still another object of the present invention is to comprise a pair of front upper braces, a pair of rear upper braces, a pair of front lower braces, and a pair of rear lower braces each having a first end attached to front and rear leg assemblies, respectively, via a pivot. The second end of each of the pair of front upper braces, rear upper braces, front lower braces, and rear lower braces are pivotally attached to the hub. In a preferred embodiment, the second ends are attached via a ball and socket joint.

Yet still another object of the present invention is to provide a range of convenient and aesthetic outdoor seating features including a comfortable and weatherproof fabric construction, and a pair of cup holders disposed within the arm rests, and a pair of straps to provide additional securing of the back rest to the rear leg assemblies.

Yet still another object of the present invention is to provide independent and quick adjustment of each leg assembly. Each leg assembly includes a lower leg portion telescopingly engaged within a bottom of an upper retention leg portion, where the upper retention leg portion can be secured at a desired height by engaging a spring pin mechanism with one (1) of a plurality of aperture portions disposed within the lower leg portion.

Yet still another object of the present invention is to provide each leg assembly with a foot at a lower end. In at least one (1) embodiment, the foot is pivotal such that a flat bottom surface of the foot can make secure contact with a ground or floor surface which is not level.

Yet still another object of the present invention is to provide a means to introduced compressed air to a bladder located within each of the arms rests, seat rest, and back rest.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
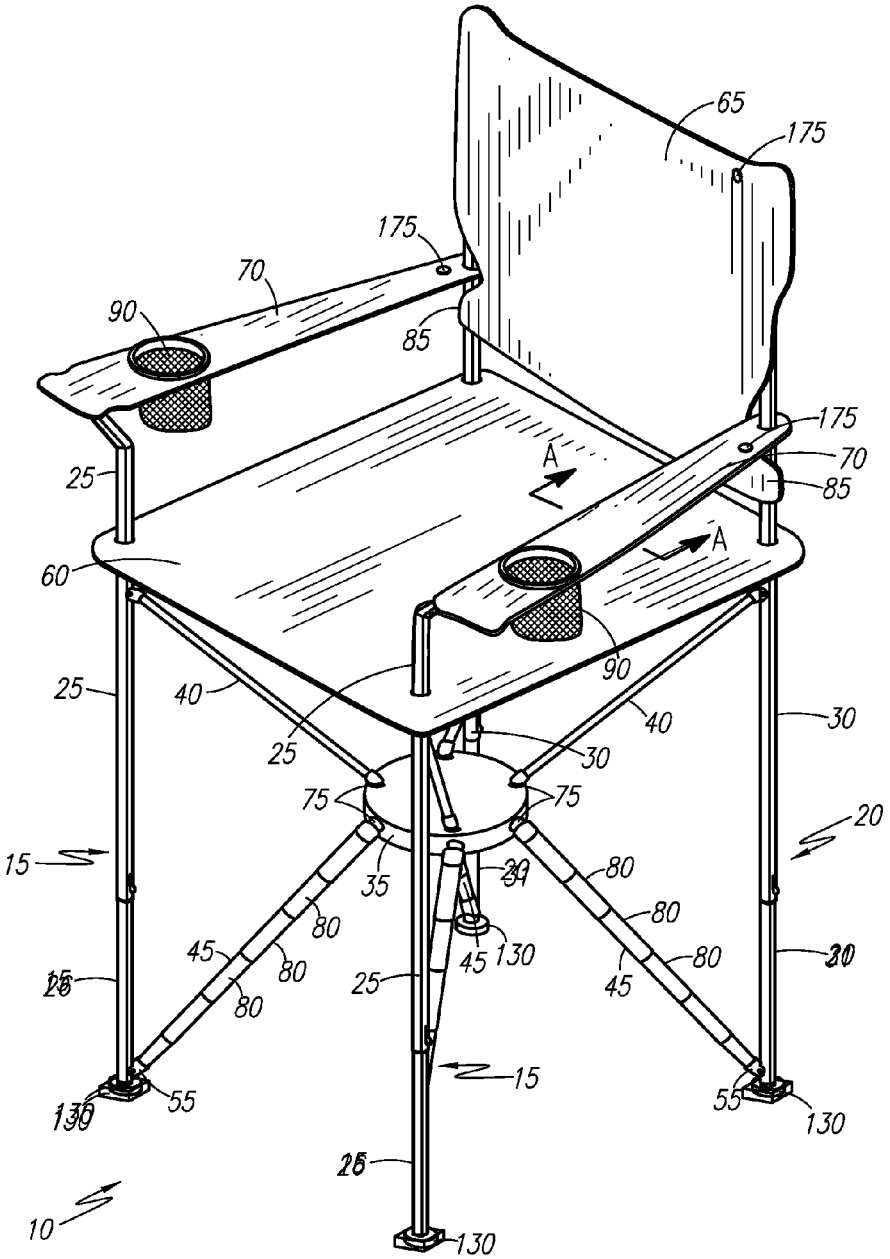
FIG. 1 is a perspective view of a folding chair with independently adjustable legs 10, according to a preferred embodiment.

10 folding chair
15 front leg assembly
20 rear leg assembly
25 front upper retention leg
26 front lower leg
30 rear upper retention leg
31 rear lower leg
35 central hub
40 upper folding brace arm
45 lower retracting brace arm
50 upper hinged connection means
55 lower hinged connection means
60 seat rest
65 back rest
70 arm rest
75 pivoting brace support
80 sliding segment
85 back rest strap
90 cup holder
95 apertures
100 spring arm
105 fastener
110 pin
115 outer opening
120 operating lever
125 travel path "t"
130 foot
135 travel path "R"
140 ball connection
145 socket connection
150 upper fabric surface
155 lower fabric surface
160 binding edge
165 bladder
170 gas medium
175 port

DETAILED DESCRIPTION OF THE PREFERRED EMBODIMENT

Figure 2:
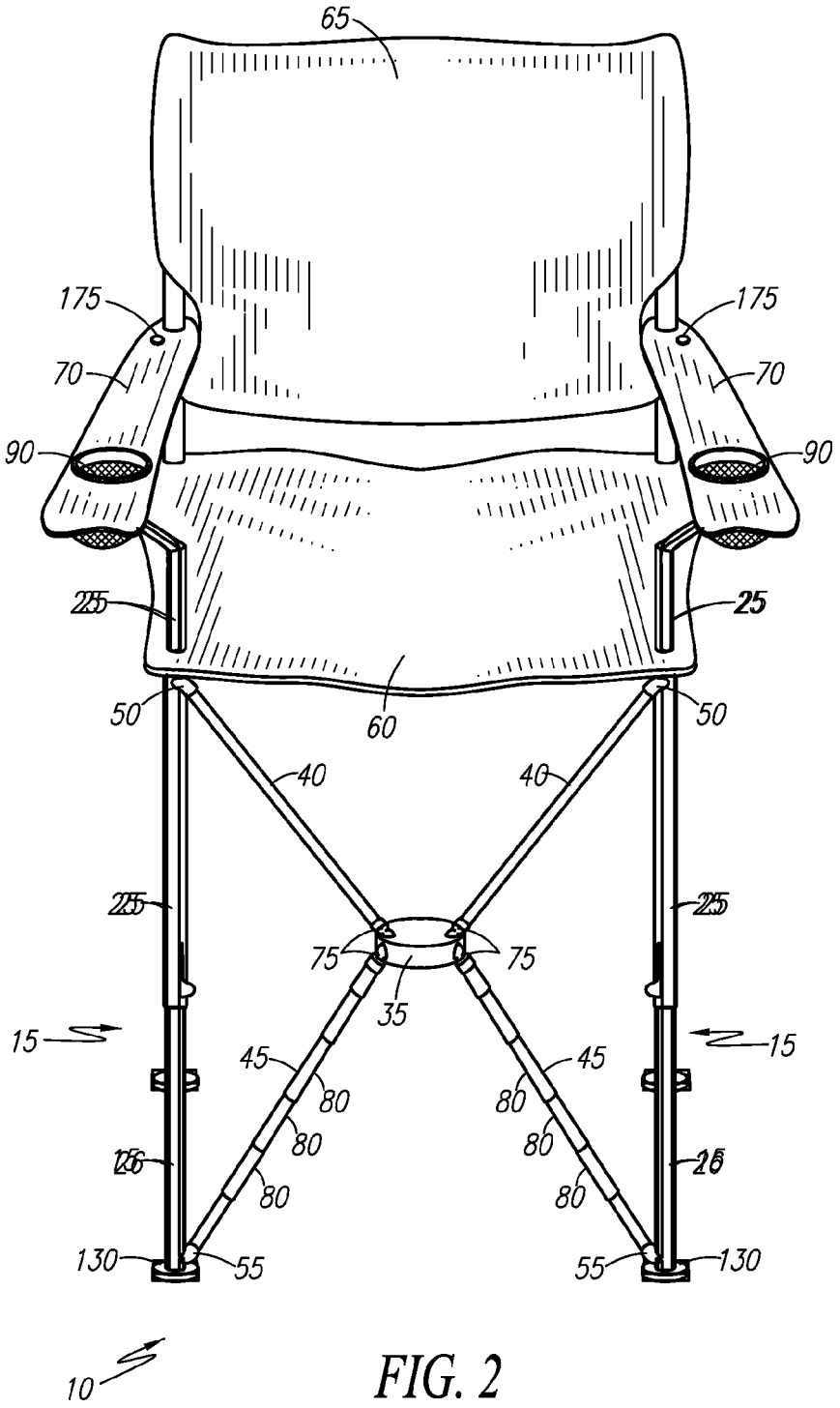
FIG. 2 is a front view of the folding chair with independently adjustable legs 10, according to a preferred embodiment of the present invention.
Figure 3:
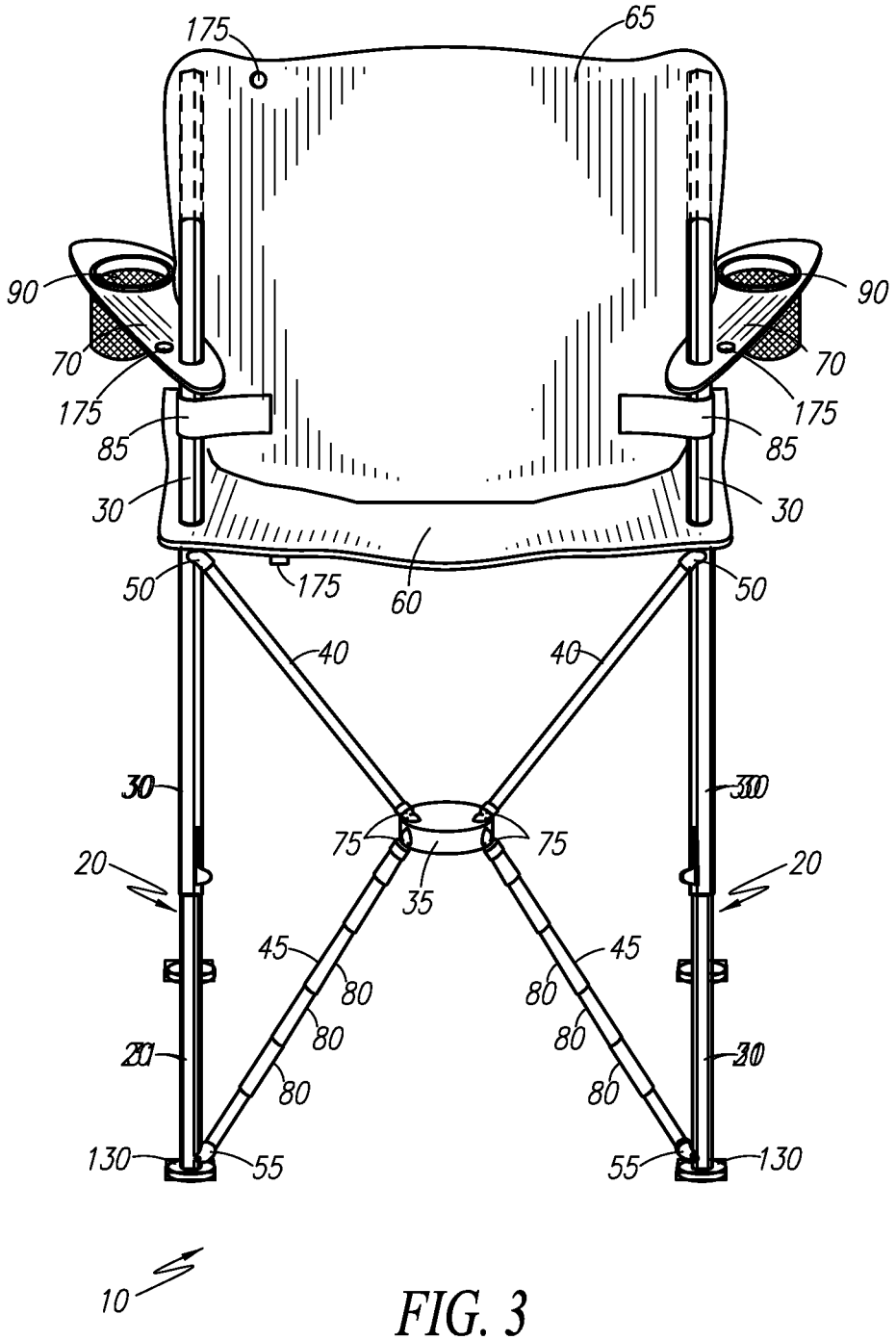
FIG. 3 is a rear view of the folding chair with independently adjustable legs 10, according to a preferred embodiment of the present invention.

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a folding chair with independently adjustable legs (herein described as the "apparatus") 10, which provides a portable camp-style chair having two (2) front leg assemblies 15 and two (2) rear leg assemblies 20, thereby enabling use of the apparatus 10 on an uneven or sloping surface by independently extending one (1) or more of either the front leg assemblies 15 and/or the rear leg assemblies 20.

The apparatus 10 may also provide an elevated or normal seating height for use in backyards, at campouts, or when viewing amateur sporting events.

Referring now to FIGS. 1, 2, and 3, perspective, front, and rear views of the apparatus 10, according to a preferred embodiment, are disclosed. The apparatus 10 provides a means by which camp-style folding chairs 10 can be used on uneven ground without the disadvantage of reduced stability. The apparatus 10 provides a tubular metal frame comprising two (2) front lower legs 26, two (2) rear lower legs 31, two (2) front upper retention legs 25, two (2) rear upper retention legs 30, a central hub 35, four (4) upper folding brace arms 40 (only of which three (3) are shown due to illustrative limitations), and four (4) lower retracting brace arms 45 (only of which three (3) are shown due to illustrative limitations). Said front leg assemblies 15, rear leg assemblies 20, central hub 35, upper folding brace arms 40, and lower retracting brace arms 45 define a pivoting joined structure being of a rectangular shape and being easily collapsible and deployable.

Said frame is pivotally joined at end intersecting end portions via four (4) upper hinged connection means 50 and four (4) lower hinged connection means 55. The front upper retention leg 25 and the rear upper retention leg 30 provide a support means to a textile members including a seat rest 60, a back rest 65, and an arm rest 70. Said tubular members front lower legs 26, rear lower legs 31, front upper retention legs 25, and rear upper retention legs 30 are preferably made using various lengths of light-weight hollow square aluminum tubing stock being affixed to each other in a chair-like configuration via the upper hinged connection means 50 and the lower hinged connection means 55. While square stock aluminum tubing is the preferred material to provide strong and light-weight structural members, other materials having similar structural characteristics can also be used without limiting the scope or function of the apparatus 10. The front upper retention legs 25 and the rear upper retention legs 30 in conjunction with the front lower legs 26 and the rear lower legs 31 respectively extend downwardly from the upper hinged connection means 50 being located at each corner portion of the seat rest 60 of the apparatus 10. The front upper retention legs 25 and the rear upper retention legs 30 in conjunction with the front lower legs 26 and the rear lower legs 31 are supported by the upper folding brace arms 40 and the lower retracting brace arms 45 being pivotally joined at the central hub 35 through a series of eight (8) pivoting brace supports 75, thereby enabling compact horizontally collapsing and folding of the front upper retention legs 25 and the rear upper retention legs 30 in conjunction with the front lower legs 26 and the rear lower legs 31 along with the upper folding brace arms 40 and the lower retracting brace arms 45 operating in conjunction with the central hub 35 and the upper folding brace arms 40 of the apparatus 10.

The cross members formed by the upper folding brace arms 40 and the lower retracting brace arms 45 are arranged in pairs forming "X"-shaped structures being rotatingly attached at the central hub 35 with the aid of the pivoting brace supports 75. Said action allows the upper folding brace arms 40 to fold down during the stowing process of the apparatus 10, while the lower retracting brace arms 45 retract inward simultaneously. The lower retracting brace arms 45 are comprised of progressively smaller sliding segments 80 that capsize upon themselves. The upper folding brace arms 40 provide additional upward support to the front upper retention legs 25 and the rear upper retention legs 30 as they pass through front corner portions of the seat rest 60 and are sewingly attached to. The front upper retention legs 25 pass through the seat rest 60 and forms an integral supporting structure for the arm rest 70. Likewise the rear upper retention legs 30 pass through the seat rest 60 and form an integral supporting structure for the back rest 65. The four (4) lower retracting brace arms 45 extend and collapse as required to allow the apparatus 10 to fold into the closing position. The four (4) upper folding brace arms 40 fold down as the bottom arms retract inside themselves thus allowing the apparatus 10 to fold open and closed. Said operation is accomplished by the central hub 35 which functions as a joint system for moving up and down thus allowing for deployment and stowage of the apparatus 10.

The seat rest 60, the back rest 65, and the arm rest 70 portions of the apparatus 10 comprise textile panels which are sewingly attached to and spanning across the structural tubular portions front upper retention legs 25 and rear upper retention legs 30 to provide a comfortable seating means to a user. Said seat rest 60, back rest 65, and arm rest 70 portions are preferably made using a canvas material, however, it is appreciated that other durable textile materials may be used with equal benefit, including but not limited to: nylon, webbing, or similar materials. Said textile rest portions 60, 65, and 70 are envisioned to be introduced in various attractive colors and patterns. The apparatus 10 is illustrated here having separate seat rest 60, back rest 65 and arm rest 70 portions, however, it is understood that the rest portions 60, 65, and arm 70 of the apparatus 10 may be provided as a unitary member. Said seat rest 60, back rest 65 and arm rest 70 portions are envisioned to include sleeves, grommets, and other fastening means to receive and affix the front upper retention leg 25 and rear upper retention leg 30 portions of the apparatus 10 also using mechanical fasteners, including but not limited to screws, bolts, rivets, or similar means. The back rest 65 is illustrated here utilizing sewn-in back rest straps 85 along opposite sides to provide stable attachment to a respective adjacent rear upper retention leg 30.

The front end portion of each arm rest 70 is sewingly affixed to the front upper retention legs 25 which is provided at an offset angle at its upper end. The rear portion of the arm rest 70 is attached to a top end portion of each rear upper retention leg 30. Both, or one (1) of the arm rest 70 further comprises a sewn-in cylindrical textile or webbing cup holder 90 extends downwardly from the arm rest 70 being sized so as to encompass a standard beverage container.

Each of the front lower legs 26 and the rear lower legs 31 also include a foot 130 at a lower end portion. Each foot 130 is preferably made of a durable plastic or rubber material and is pivotally connected to said front lower legs 26 and rear lower legs 31 such that a flat bottom surface of the foot 130 can make contact with a ground or floor surface which may not be level. Each foot 130 is preferably of a flat rectangular shape sufficient in area so as to provide sufficient lateral stability as well as distributing of a weight of the occupant.

Figure 4:
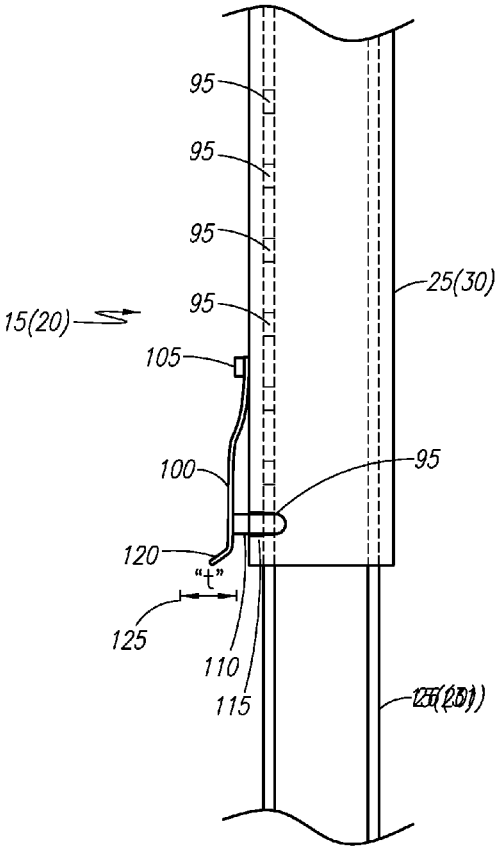
FIG. 4 is a detailed view of the of the interface between either the front leg assembly 15 and the front upper retention leg 25 or the rear leg assembly 20 and the rear upper retention leg 30, as used with the folding chair with independently adjustable legs 10, according to a preferred embodiment of the present invention.

Referring now to FIG. 4, a detailed view of the interface between either a front lower leg 26 and a front upper retention leg 25 or a rear lower leg 31 and a rear upper retention leg 30, is disclosed. The front lower leg 26 and the front upper retention leg 25 represent a front leg assembly 15 of the apparatus 10 while the rear lower leg 31 and the rear upper retention leg 30 represent a rear leg assembly 20 of the apparatus 10. Henceforth, the description provide herein below will utilize the front lower leg 26 and the front upper retention leg 25 with the understanding by those skilled in the art that a similar description will equally apply to the rear lower leg 31 and the rear upper retention leg 30. The front lower leg 26 is of a slightly smaller cross-sectional size when compared to the front upper retention leg 25 thus allowing it to slide inside due to the hollow nature of the front upper retention leg 25. The front lower leg 26 is provided with a series of apertures 95 arranged in a linear fashion. The spacing between each apertures 95 is envisioned to be approximately one-half inch (½ in.) apart in an equally-spaced manner along an outward-facing surface of said front lower leg 26. The front upper retention leg 25 is provide with a spring arm 100 that is mechanically attached with the aid of a fastener 105 envisioned to be a rivet, screw, weld or similar means. The lower end of the spring arm 100 is provided with a pin 110 which engages an appropriate apertures 95 in the front lower leg 26 through an outer opening 115 in the front upper retention leg 25. The spring arm 100 is manually manipulated with the aid of an operating lever 120 which moves along a travel path "t" 125. Said arrangement allows for the adjustment of the front lower leg 26 to a particular height as required by local grade conditions upon which the apparatus 10 is set, or upon the desire for an apparatus 10 at a specific overall higher or lower height.

Figure 5:
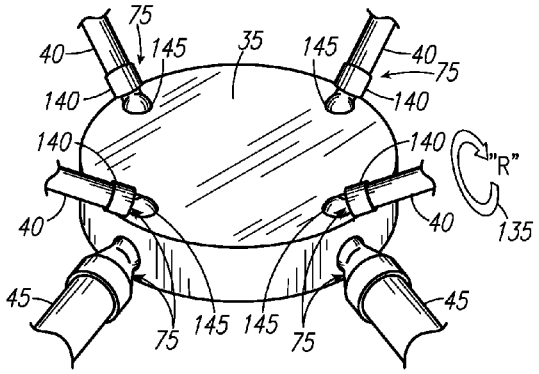
FIG. 5 is a detailed view of the central hub 35 as used with the folding chair with independently adjustable legs 10, according to a preferred embodiment of the present invention; and, FIG. 6 is a sectional view of the arm rest 70 as seen along a line A-A as shown in FIG. 1, according the preferred embodiment of the present invention.

Referring now to FIG. 5, a detailed view of the central hub 35 as used with the folding chair with independently adjustable legs 10 is depicted. The central hub 35 is shown with the four (4) upper folding brace arms 40 extending radially outward while only two (2) of the four (4) lower retracting brace arms 45 are shown due to illustrative limitations. The upper folding brace arms 40 and the lower retracting brace arms 45 are mechanically connected via the pivoting brace supports 75 which allows for movement in a three hundred sixty degree (360°) path as depicted by a travel path "r" 135. The rotational movement described by the travel path "r" 135 is afforded by a ball connection 140 on the inward face of the pivoting brace supports 75 and a socket connection 145 provided on the travel path "r" 135. Said ball connection 140 and upper fabric surface 150 are provided for a total of eight (8) occurrences and are envisioned to be manufactured from high strength impact resistant plastic in an injection molding process. However it is realized by those skilled in the art that other materials and even movement devices are possible, thus the provided description or material is not intended to be a limiting factor of the present invention.

Figure 6:
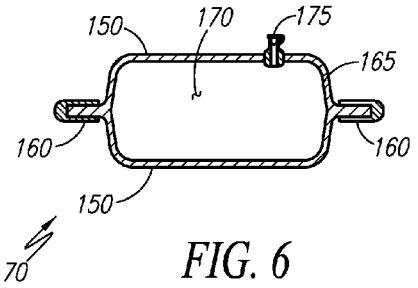

Referring now to FIG. 6, a sectional view of the arm rest 70 as seen along a line A-A as shown in FIG. 1, according the preferred embodiment of the present invention, is disclosed. The arm rest 70 includes an upper fabric surface 150 and a lower fabric surface 155 joined together by a binding edge 160 and secured by a suitable means such as sewing or adhesive. The interior space between the upper fabric surface 150 and the lower fabric surface 155 is provided with a bladder 165. The bladder 165 is inflated under pressure, and is filled with a suitable gas medium 170 such as air. The gas medium 170 is inserted and likewise removed from the bladder 165 via a port 175. The port 175 is located at a rear section of the arm rest 70 as shown in FIG. 1, FIG. 2 and FIG. 3. In a similar manner, the seat rest 60 and backrest 65 are each provided with a bladder 165 and an associated port 175 as well. A bladder 165 is located inside of the seat rest 60 and the back rest 65 as well. The apparatus 10 is envisioned to be introduced in various models such as children and adult sizes being scaled up or down for differently sized users. The materials required to produce the apparatus 10 are all readily available and well known to manufacturers of goods of this type. The apparatus 10 would be made following many of the same processes and procedures to produce conventional folding camp chairs. Such processes as metal extrusion, metal finishing, textile cutting and sewing, and the like would be used. The front lower leg 26 and the rear lower leg 31 are sized so as to be snuggly inserted into respective front upper retention leg 25 and rear upper retention leg 30. The spring arm 100, pin 110, central hub 35, pivoting brace supports 75, upper folding brace arms 40 and lower retracting brace arms 45 along with the seat rest 60, back rest 65, and arm rest 70, would best be procured from wholesalers and manufacturers that deal in goods of that nature and assembled at a final location.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 through 6.

The method of utilizing the apparatus 10 upon an uneven surface may be achieved by performing the following steps: procuring a desired size and color apparatus 10; deploying the apparatus 10 by horizontally extending the front lower leg 26 and the rear lower leg 31 from the front upper retention leg 25 and the rear upper retention leg 30 respectively outwardly, if not previously deployed; and automatically securing the apparatus 10 in a deployed state by extension of the lower retracting brace arms 45 and deployment of the upper folding brace arms 40 from the central hub 35 in conjunction with the upper hinged connection means 50 and the lower hinged connection means 55; establishing a level seat rest 60 by adjusting the length of each front lower leg 26 and/or rear lower leg 31 in turn by manipulating each operating lever 120 to retract the pin 110 from the apertures 95 and reinserting each pin 110 into another apertures 95 as required; repeating the length adjustment procedure until obtaining suitable level contact with an uneven ground surface; inflating the bladder 165 in each seat rest 60, back rest 65 and arm rest 70 by use of an electric pump, a manual pump or manual inflation via the user's mouth and lungs; utilizing the apparatus 10 to normal seating upon said uneven surface for a period of time; compactly folding the apparatus 10 by deflating the bladder 165 in each seat rest 60, back rest 65 and arm rest 70 using respective port 175 portions; retracting the front lower leg 26 and the rear lower leg 31 into the front upper retention leg 25 and the rear upper retention leg 30 respectively while simultaneously folding the upper folding brace arms 40 in conjunction with the pivoting brace supports 75 and the upper hinged connection means 50 and retracting the lower retracting brace arms 45 along the sliding segments 80 in conjunction with the pivoting brace supports 75 and the lower hinged connection means 55 toward a center point until the apparatus 10 is completely collapsed; storing the apparatus 10 until needed again; and, benefiting from a light-weight and portable chair apparatus 10 which provides level seating upon uneven surfaces.

The method of utilizing the apparatus 10 to obtain an elevated seat rest 60 may be achieved by extending all two (2) front lower legs 26 and all two (2) rear lower leg 31 to a uniform desired length, allowing the apparatus 10 to be utilized by a tall person, or to obtain an improved elevated view of sporting events and the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A folding chair comprising:

a chair frame, comprising:

a pair of rear leg assemblies;

a pair of front leg assemblies;

a hub centrally located equidistant from said pair of rear leg assembles and said pair of front leg assemblies;

a pair of rear upper brace arms, each joined to an upper end of one rear leg assembly at a first end and a rear upper position of said hub at a second end;

a pair of front upper brace arms, each joined to an upper end of one front leg assembly at a first end and a front upper position of said hub at a second end;

a pair of rear lower brace arms, each joined to a lower end of one rear leg assembly at a first end and a rear side position of said hub at a second end; and, a pair of front lower brace arms, each joined to a lower end of one front leg assembly at a first end and a front side position of said hub at a second end;

a pair of arm rests, each spanning between one rear leg and one front leg on a common side;

a seat rest horizontally disposed, supported by, and spanning an area between said pair of front leg assemblies and said pair of rear leg assemblies;

a back rest vertically disposed, supported by, and spanning an area between said pair of rear leg assemblies;

wherein said chair frame is selectively collapsible and deployable;

wherein said pair of rear leg assemblies extend from an upper location of said seat rest at an upper end to a lower end coextensive with a lower end of said pair of front leg assemblies, and said pair of front leg assemblies each extend from an arm rest at an upper end to a lower end coextensive with said lower end of said pair of rear leg assemblies; and, wherein each of said pair of rear leg assemblies and said pair of front leg assemblies comprise:

an upper retention leg;

a lower retention leg slidingly engaging within said upper retention leg; and, an adjustable securing means for securing a position of said lower leg relative to said upper retention leg.

2. The folding chair of claim 1, wherein:

said first end of each of said pair of rear upper brace arms, said pair of front upper brace arms, said pair of rear lower brace arms, and said pair of front lower brace arms are pivotally joined to said rear and front leg assemblies, respectively; and, said second end of each of said pair of rear upper brace arms, said pair of front upper brace arms, said pair of rear lower brace arms, and said pair of front lower brace arms are pivotally joined to said hub.

3. The folding chair of claim 1, wherein each of said pair of rear lower brace arms and said pair of front lower brace arms are comprised of telescoping segments.

4. The folding chair of claim 1, further comprising a pair of straps each affixed to opposing sides adjacent to a lower edge of said back rest for secure attachment to one rear leg.

5. The folding chair of claim 1, further comprising a foot located at terminal lower ends of each of said pair of rear leg assemblies and said pair of front leg assemblies.

6. The folding chair of claim 1, wherein said chair frame is fabricated out of square stock aluminum tubing.

7. The folding chair of claim 1, further comprising a webbed cup holder located in either one or both of said pair of arm rests.

8. The folding chair of claim 1, wherein said arm rest, said seat rest, and said back rest together comprise a unitary construction.

9. A folding chair comprising:

a chair frame, comprising:

a pair of rear leg assemblies;

a pair of front leg assemblies;

a hub centrally located equidistant from said pair of rear leg assembles and said pair of front leg assemblies;

a pair of rear upper brace arms, each joined to an upper end of one rear leg assembly at a first end and a rear upper position of said hub at a second end;

a pair of front upper brace arms, each joined to an upper end of one front leg assembly at a first end and a front upper position of said hub at a second end;

a pair of rear lower brace arms, each joined to a lower end of one rear leg assembly at a first end and a rear side position of said hub at a second end; and, a pair of front lower brace arms, each joined to a lower end of one front leg assembly at a first end and a front side position of said hub at a second end;

a pair of arm rests, each spanning between one rear leg and one front leg on a common side;

a seat rest horizontally disposed, supported by, and spanning an area between said pair of front leg assemblies and said pair of rear leg assemblies;

a back rest vertically disposed, supported by, and spanning an area between said pair of rear leg assemblies;

wherein said chair frame is selectively collapsible and deployable; and, wherein each of said pair of arm rests, said seat rest, and said back rest comprises a bladder secured between a first material and a second material configured to be in pneumatic communication with a compressed air source;

wherein said pair of rear leg assemblies extend from an upper location of said seat rest at an upper end to a lower end coextensive with a lower end of said pair of front leg assemblies, and said pair of front leg assemblies each extend from an arm rest at an upper end to a lower end coextensive with said lower end of said pair of rear leg assemblies; and, wherein each of said pair of rear leg assemblies and said pair of front leg assemblies comprise:

an upper retention leg;

a lower retention leg slidingly engaging within said upper retention leg; and, an adjustable securing means for securing a position of said lower leg relative to said upper retention leg.

10. The folding chair of claim 9, wherein:

said first end of each of said pair of rear upper brace arms, said pair of front upper brace arms, said pair of rear lower brace arms, and said pair of front lower brace arms are pivotally joined to said rear and front leg assemblies, respectively; and, said second end of each of said pair of rear upper brace arms, said pair of front upper brace arms, said pair of rear lower brace arms, and said pair of front lower brace arms are pivotally joined to said hub.

11. The folding chair of claim 9, wherein each of said pair of rear lower brace arms and said pair of front lower brace arms are comprised of telescoping segments.

12. The folding chair of claim 9, further comprising a pair of straps each affixed to opposing sides adjacent to a lower edge of said back rest for secure attachment to one rear leg.

13. The folding chair of claim 9, further comprising a foot located at terminal lower ends of each of said pair of rear leg assemblies and said pair of front leg assemblies.

14. The folding chair of claim 9, wherein said chair frame is fabricated out of square stock aluminum tubing.

15. The folding chair of claim 9, further comprising a webbed cup holder located in either one or both of said pair of arm rests.

16. The folding chair of claim 9, wherein said arm rest, said seat rest, and said back rest together comprise a unitary construction.

* * * * *